United States Patent [19]

Griffin et al.

[11] Patent Number: 4,660,456

[45] Date of Patent: Apr. 28, 1987

[54] AIRBORNE MISSILE LAUNCHER OF MODULAR CONSTRUCTION

[75] Inventors: Dennis Griffin, Guildford; Charles A. Field, Kingston-upon-Thames, both of England

[73] Assignee: Frazer-Nash Limited, Great Britain

[21] Appl. No.: 656,935

[22] Filed: Oct. 2, 1984

[30] Foreign Application Priority Data

Oct. 3, 1983 [GB] United Kingdom ..... 8326438

[51] Int. Cl.[4] ..... F41F 7/00

[52] U.S. Cl. ..... 89/1.819; 89/1.813; 89/1.56; 244/127

[58] Field of Search ..... 89/1.819, 1.59, 1.813; 244/127

[56] References Cited

U.S. PATENT DOCUMENTS

| | | | |
|---|---|---|---|
| 3,228,297 | 1/1966 | Kossan et al. | 89/1.819 X |
| 3,276,317 | 10/1966 | Kossan et al. | 89/1.819 X |
| 3,771,416 | 11/1973 | Ackerman, Jr. et al. | 89/1.819 X |
| 4,494,438 | 1/1985 | Lighton et al. | 89/1.819 X |

*Primary Examiner*—Peter A. Nelson

*Attorney, Agent, or Firm*—Hall, Myers & Rose

[57] ABSTRACT

An airborne missile launcher is provided which is of modular construction to carry a variety of different missiles. A main body section has top attachment points, whereby it is carried by an aircraft, and sub-rail hangers at its underside to receive alternative missile-carrying sub-rails each of which sub-rails has one or more longitudinal tracks for carrying one or more types of missile. The sub-rail may be mounted in telescopically sliding relationship with the main body section. To complete the launcher body, forward and aft body sections are attached to the main body section, each of the forward and aft body sections being selected from a number of different such sections to suit different types of missile. For certain missile types, the forward and aft sections may be simply a plastics fairing; for certain other missile types, the forward and aft section may house a missile umbilical retraction mechanism and other operative means.

15 Claims, 14 Drawing Figures

AIRBORNE MISSILE LAUNCHER OF MODULAR CONSTRUCTION

This invention relates to missile launchers and, more particularly, launchers of the fixed body rail type to be borne by aircraft.

With this type of launcher the propulsion motor of the missile is ignited to initiate launch and when the missile motor thrust has built up to a certain value a release mechanism operates automatically, as a consequence of that thrust, allowing the missile to leave the launcher by being propelled forward along the launcher rail. Until the missile is launched an umbilical connection must be maintained between the aircraft and the missile, via the launcher body. Since different missiles have different lengths, different arrangements of suspension hooks and different positioning of the umbilical connection along the missile body, each design of launcher has hitherto been capable of carrying only one type, or exceptionally two types, of missile, and has commonly needed to be of a length that is substantially the same as or a major proportion of the length of the missile.

It is an object of the present invention to improve considerably on this situation by providing a launcher that can be adapted to carry a number of different types of missile and yet involves lower weight, size and drag penalites than existing launchers.

According to the invention, the missile launcher is of modular construction comprising:

(i) as a main module, an intermediate main body section usable with all the types of missile to be carried and of a length less than full body length, adapted for fixing to an aircraft and further adapted to receive a forward section and an aft section to complete the body length;

(ii) as a forward module, a forward or nose section selected to suit the type of missile to be carried and releasably fixed to the forward end of the main body section;

(iii) as an aft module, an aft or tail section selected to suit the type of missile to be carried and releasably fixed to the aft end of the main body section; and (iv) as a further module, a sub-rail adapted to carry a missile and selected to suit the type of missile to be carried, said sub-rail being releasably attached to the underside of said main body section.

The sub-rail may have longitudinal guides whereon it slides telescopically along the main body section, the sub-rail and missile moving forward together during the launch sequence until just prior to full extension of the sub-rail, and the missile continuing its travel thereafter alone along a set of tracks on the sub-rail.

Figures 1A, 1B, 1C:
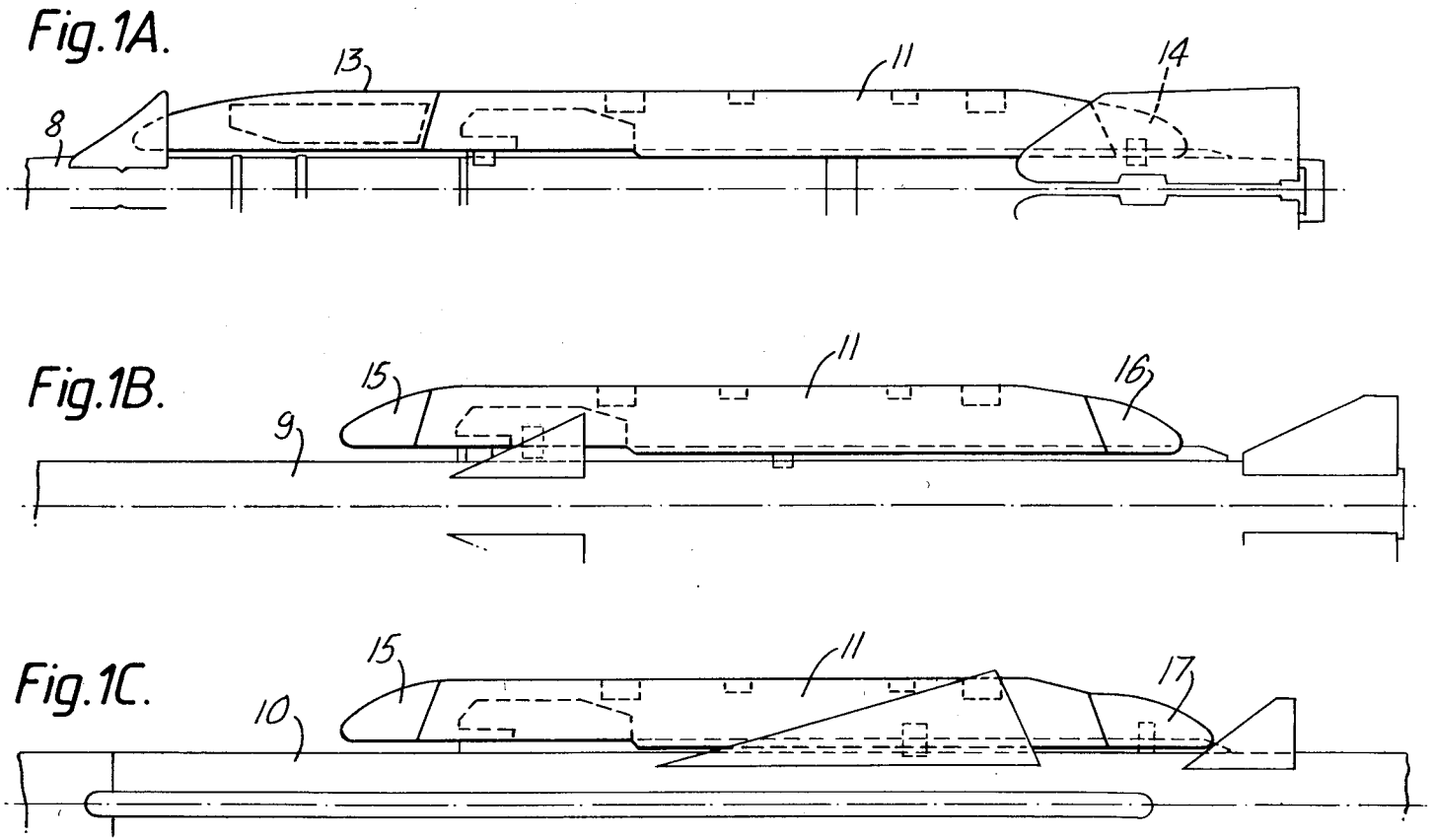
Figure 2:
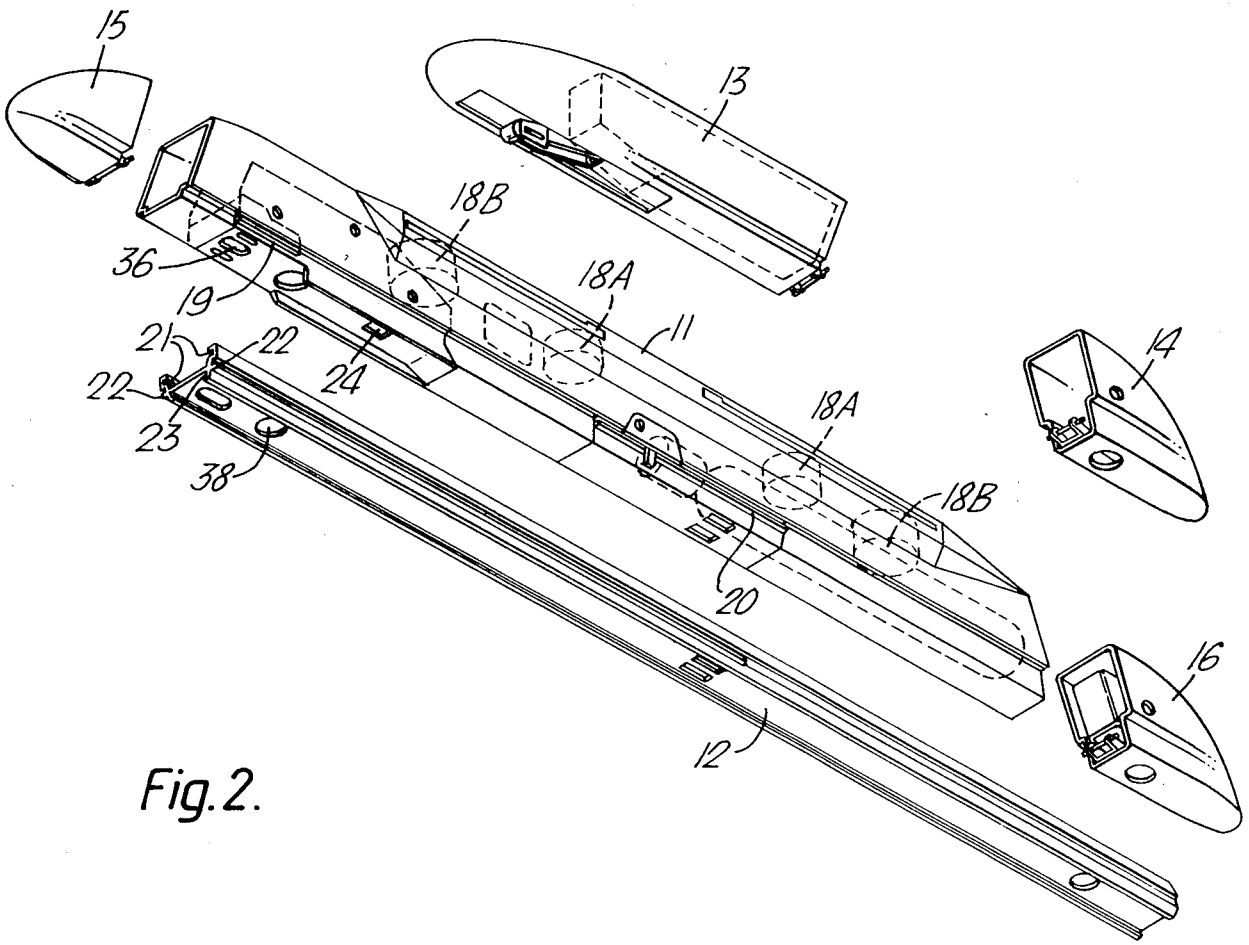

The invention will be more fully understood from the following description of one embodiment thereof, given by way of example and with reference to the accompanying drawings, wherein:

FIGS. 1A, 1B and 1C are diagrammatic side elevations showing a missile launcher according to the invention carrying sidewinder, AMRAAM and ALARM missiles respectively, FIG. 2 is an exploded pictorial view of the missile launcher showing interchangeable forward and aft modules, FIGS. 3A to 3D together form a side view in longitudinal section of the missile launcher arranged for the carriage of sidewinder and AMRAAM missiles.

Figure 3A:
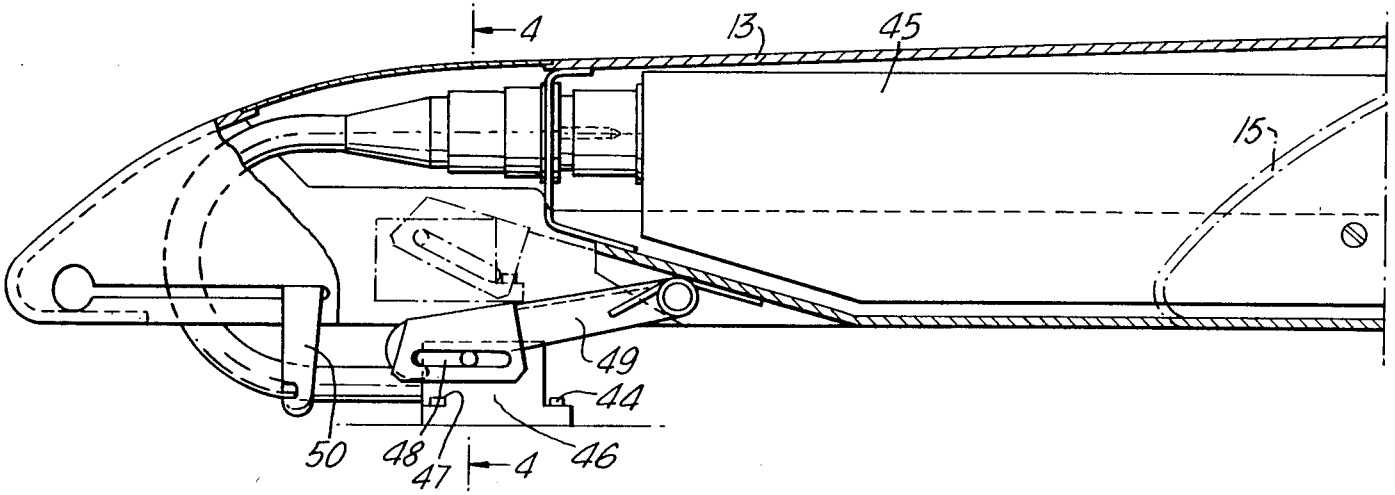
Figure 3B:
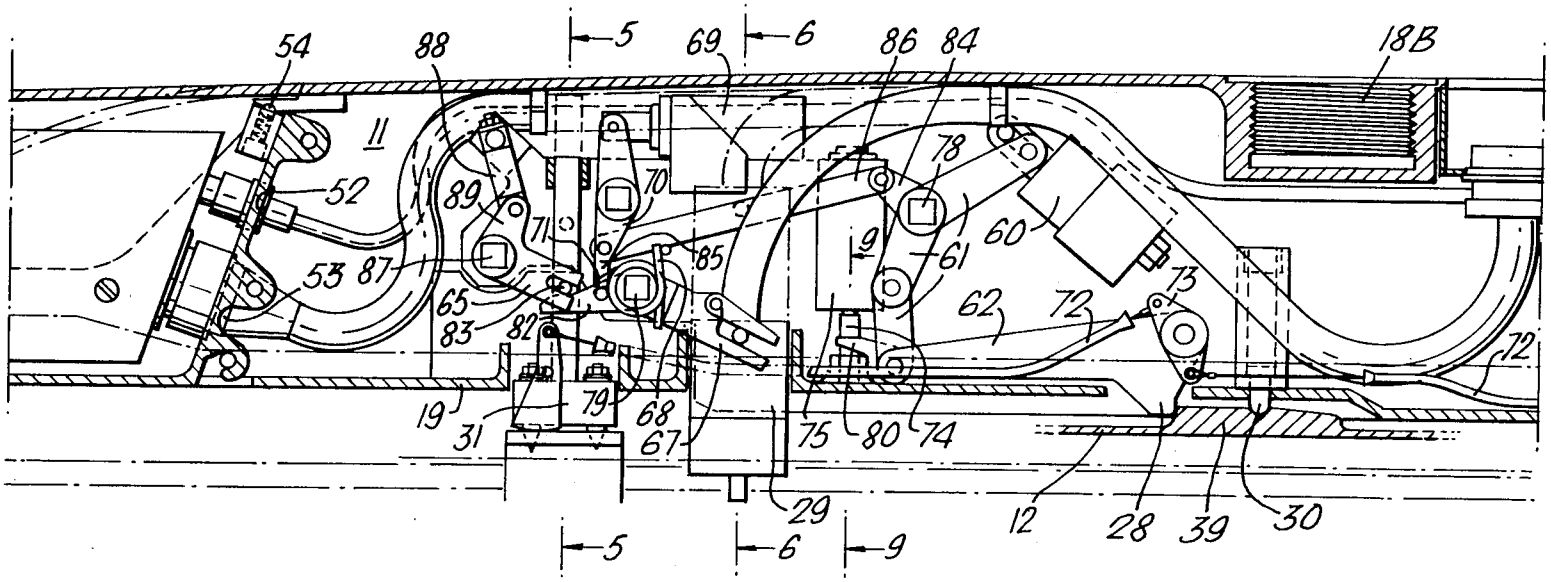
Figure 3C:
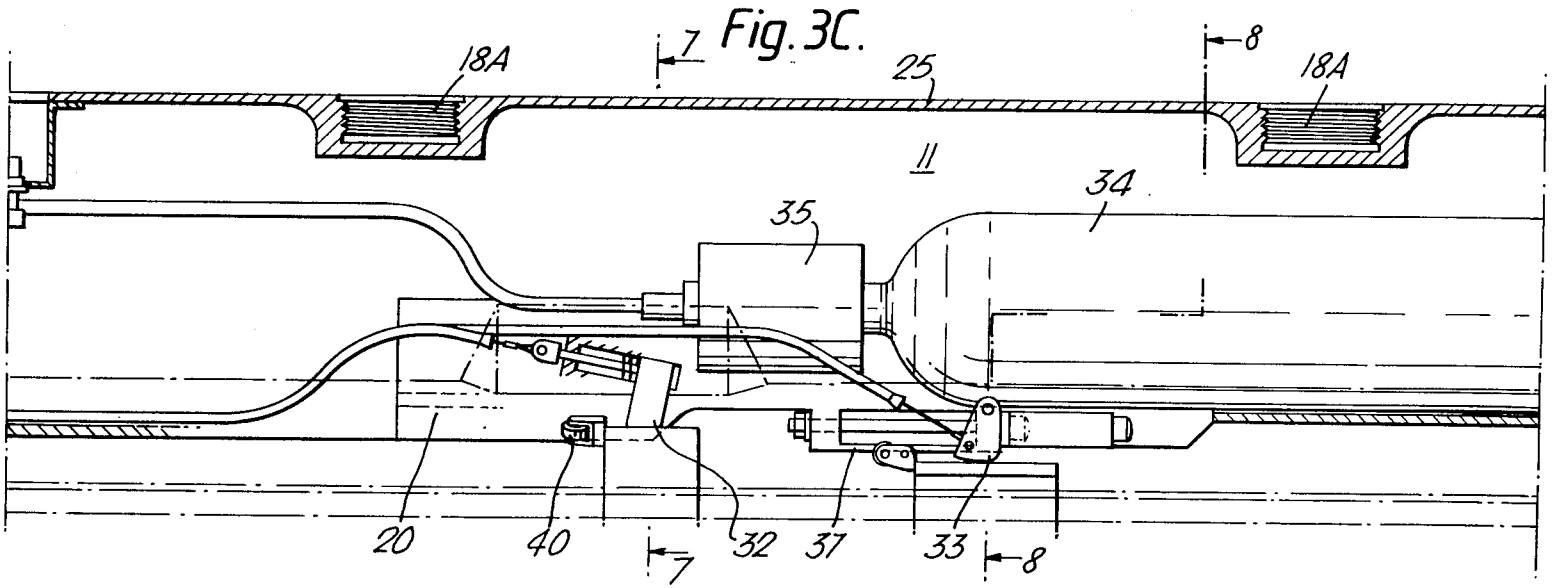
Figure 3D:
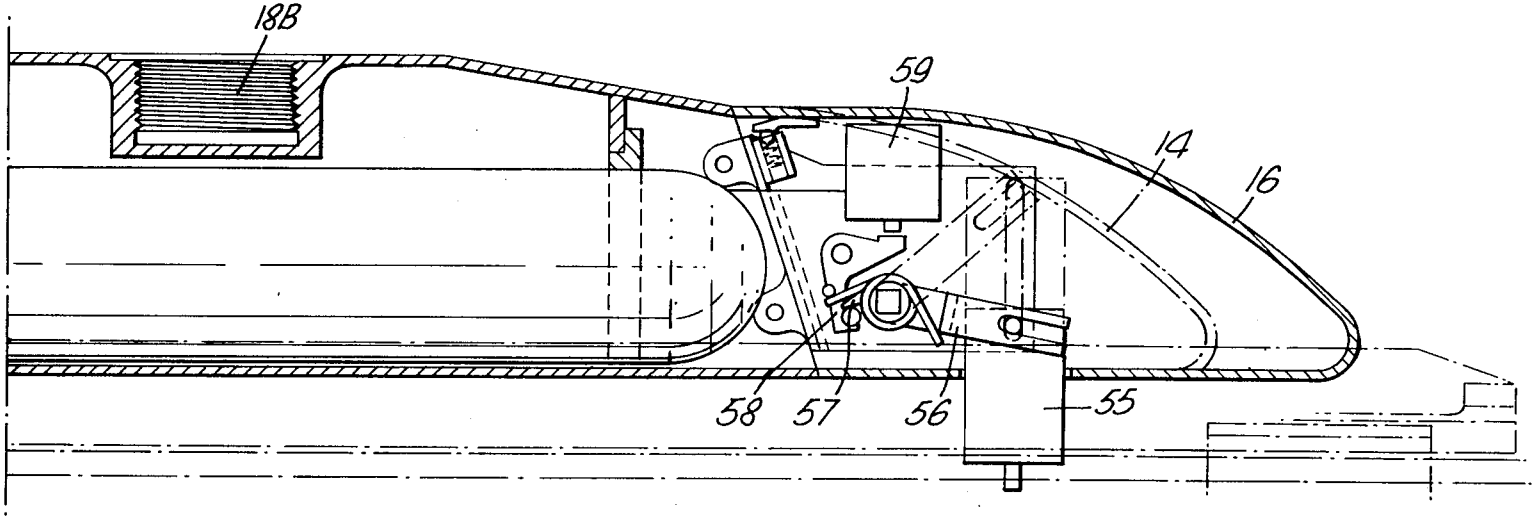
Figure 4:
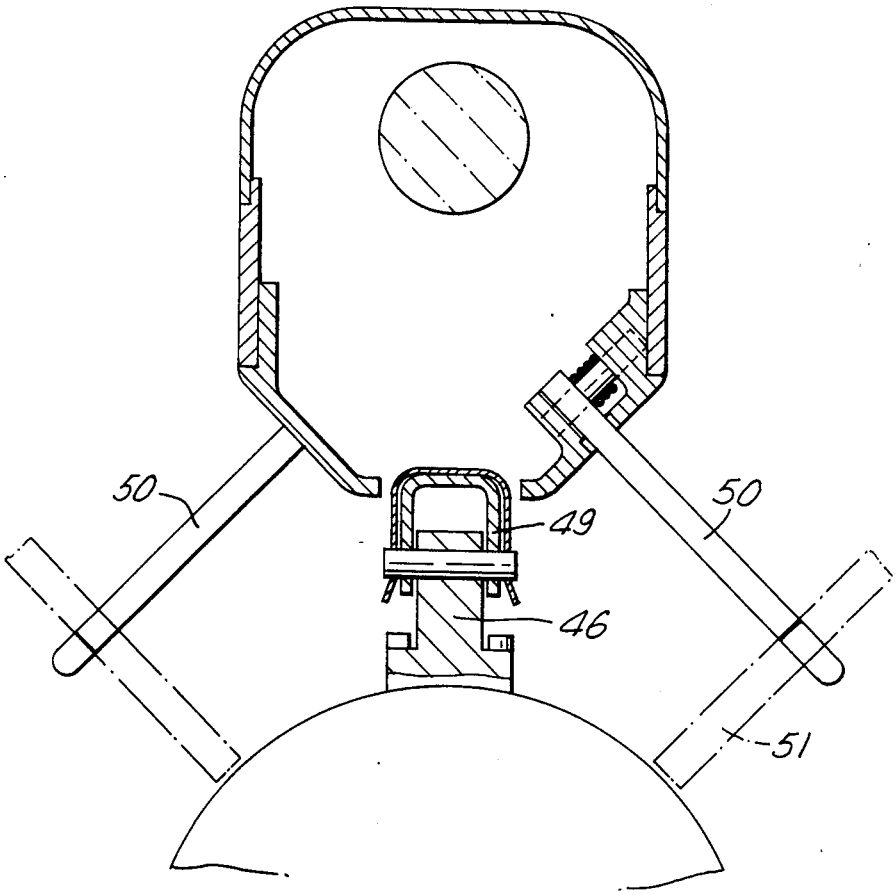
Figure 5:
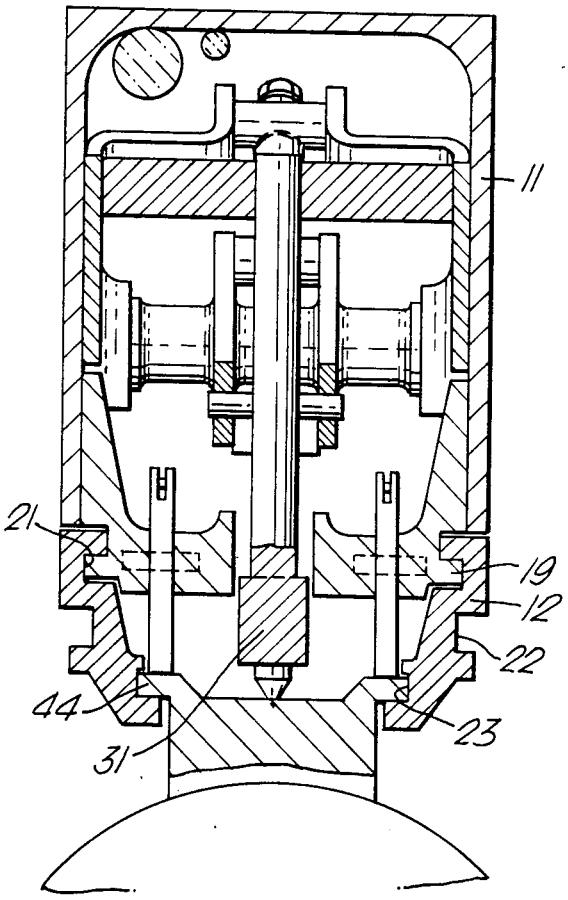
Figure 6:
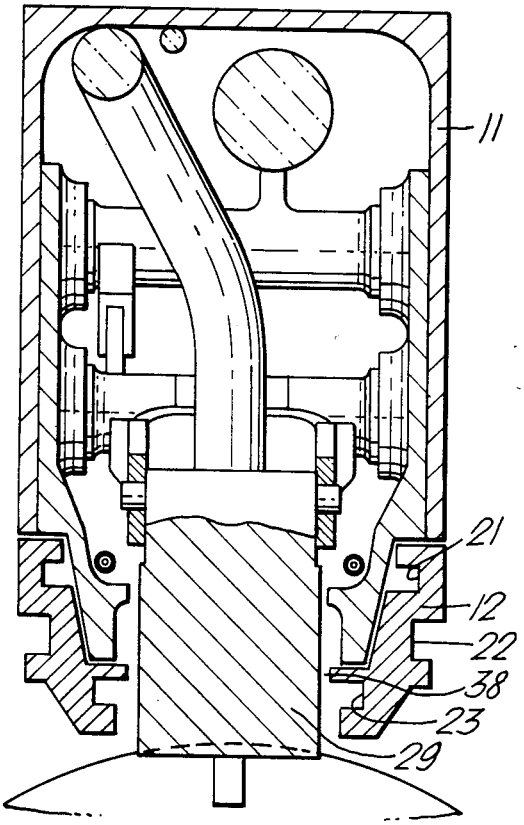
Figure 9:
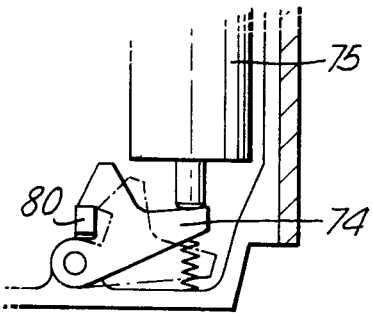

FIGS. 4 to 8 are cross-sections taken on the lines 4—4 to 8—8, respectively of FIGS. 3A and 3B, and FIG. 9 is a cross-section on the line 9—9 of FIG. 3A.

Referring firstly to FIGS. 1A, 1B and 1C, the missile launcher to be described is shown diagrammatically adapted to carry, respectively, sidewinder, AMRAAM and ALARM type missiles 8, 9, 10. All configurations have the same main body 11 but the forward and aft modules 13, 15, 14, 16, 17 and the sub rail 12 carrying the missile can be varied to suit the different missile types. FIG. 2 is is an exploded view showing the main body 11, a sub-rail 12 suitable forboth sidewinder and AMRAAM, an AMRAAM forward fairing 15 and aft module 16, and a sidewinder forward module 13 and aft fairing 14.

The main body 11 bears the load and incorporates pairs of standard aircraft mountings 18A, 18B at 14 inch and 30 inch centres, respectively. Underneath the main body are two steel hangers 19, 20 which engage in tracks 21 along the top of the multi-tracked sub-rail 12. The missile suspension hooks engage in one or other of two tracks 22, 23 of the sub-rail 12. The steel hangers 19, 20 are so placed along the body 11 and/or of such extent that they are in vertical alignment with the forward and centre missile hooks before launch. In this way cantilevering of the sub-rail during air carriage is avoided. In the first stage of launch, the missile motor thrust is transmitted through missile/sub-rail locks to the sub-rail. The sub-rail 12 is prevented, by means of a detent located at 24, from moving until a predetermined thrust has been developed. Upon detent release at the predetermined thrust, the sub-rail and missile move forward together. Prior to the full extension of the sub-rail the missile/sub-rail locks disengage allowing the missile to depart along the extended sub-rail as the sub-rail is arrested.

The main body 11 of the launcher allows the different forward and rear fairings to be fitted. These fairings are designed to accommodate the varying missile attachment requirements and to allow non-essential launcher components to be removed, thereby minimising weight and aerodynamic drag.

Several different sub-rails can be designed to slide on the same steel hangers 19, 20, for use as adapters for different missile suspension hook designs.

Referring now to FIGS. 3A to 3D, the main body member 11 comprises a machined channel extrusion 25 which provides the threaded mountings 18B, 18A with 30 inch and 14 inch centres, respectively. Adapters in these threaded mountings can provide interfacing to 14 inch centre and 30 inch centre MACE and crutched ejector release units (ERU'S) (our patent specification Nos. 2,072,812 and 2,078,912), while bolts at the 30 inch centre mountings can be used for pylon or wing tip attachment to an aircraft. Movable sway-brace pads 26 (FIG. 5) locate in 'fir tree' splines 27 to provide a crutching arrangement for 14 inch and 30 inch ERU'S. Access slots allow removal of these sway-brace pads when not required.

The forward part of the main body 11 contains a carriage which houses the sub-rail detent 28, a missile umbilical (AMRAAM) 29, a sub-rail latch 30 and missile striker points (sidewinder) 31. This carriage unit can be dropped out of the main body channel for maintenance purposes. Centre and aft parts of the main body house retractable missile snubbers 32, 33, and a nitrogen bottle 34 (sidewinder) with a nitrogen regulator 35.

The ends of the main body provide structural attachment for the forward and aft modular fairing assemblies.

The open underside of the main body channel 25 is enclosed by the two steel sub-rail hangers 19, 20 and extruded alloy cover plates. The sub-rail hangers are each attached to the side walls of the main body by a series of countersunk bolts. The forward sub-rail hanger 19, which is comparatively short, aligns vertically with all missile forward hooks. The rear sub-rail hanger 20 is comparatively long to give sub-rail support over the range of missile centre hook positions.

The rear hanger 20 incorporates two progressive buffer assemblies 37 which decelerate and stop the forward motion of the sub-rail 12 after disengagement of the missile/sub-rail locks. Each buffer assembly is a compressible stack of elastomeric rings or cups shaped so that air is entrapped between one ring and the next.

The sub-rail 12 is a machined aluminium alloy extrusion having three longitudinal tracks, the upper internal track 21 engaging with the sub-rail hangers 19, 20. Below the upper track are the internal and external tracks 23, 22 to accommodate varying missile hook profiles as shown in FIGS. 5 to 8. All tracks are hard anodised and coated with dry film lubricant for wear resistance.

As already indicated, the sub-rail and sub-rail hanger arrangement is designed for the loads before launch to be taken only through the forward and centre missile hooks. In the initial phase of a missile launch, with the missile locked to the sub-rail, the missile forward hook moves forward away from the forward sub-rail hanger; however, the missile rear hook moves towards the rear sub-rail hanger and the centre hook towards the forward sub-rail hanger thus maintaining the missile load on the sub-rail hangers. On disengagement of the missile from the sub-rail the missile centre hook passes beyond the forward sub-rail hanger whilst the rear missile hook travels between the rear and front sub-rail hangers. Over the final phase of missile/sub-rail travel, the missile carriage loads are reducing and the launcher function is predominantly trajectory control. The extended sub-rail provides rear missile hook guidance to prevent missile contact with the launcher or the aircraft.

The forward section of the sub-rail has apertures for snubbing, striker points (sidewinder) and umbilical plug (AMRAAM). Aft of the umbilical aperture 38 (FIGS. 2 and 6) is located a sub-rail restraint block 39 (FIG. 3B) which engages with the detent mechanism housed in the forward main body.

To prevent missile movement along the sub-rail, roller locks 40 are positioned to engage with all missile centre hooks. These disengage just prior to the sub-rail reaching full travel and impacting the buffers 37. At the rear of the sub-rail is a buffer block which is detachable to enable the sub-rail to be removed from the launcher.

Figure 7:
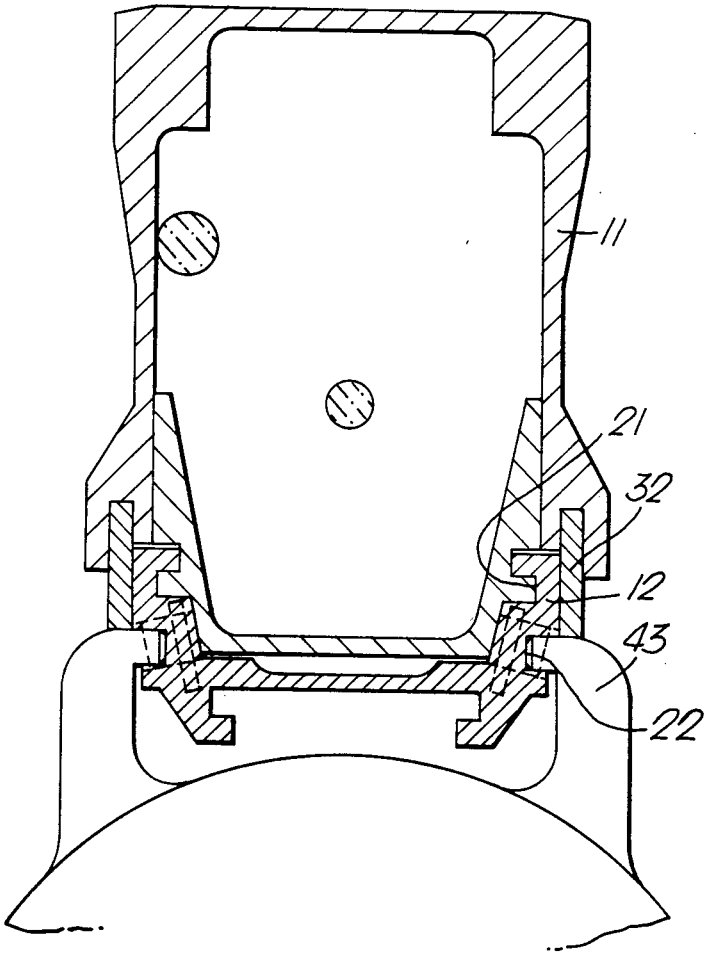
Figure 8:
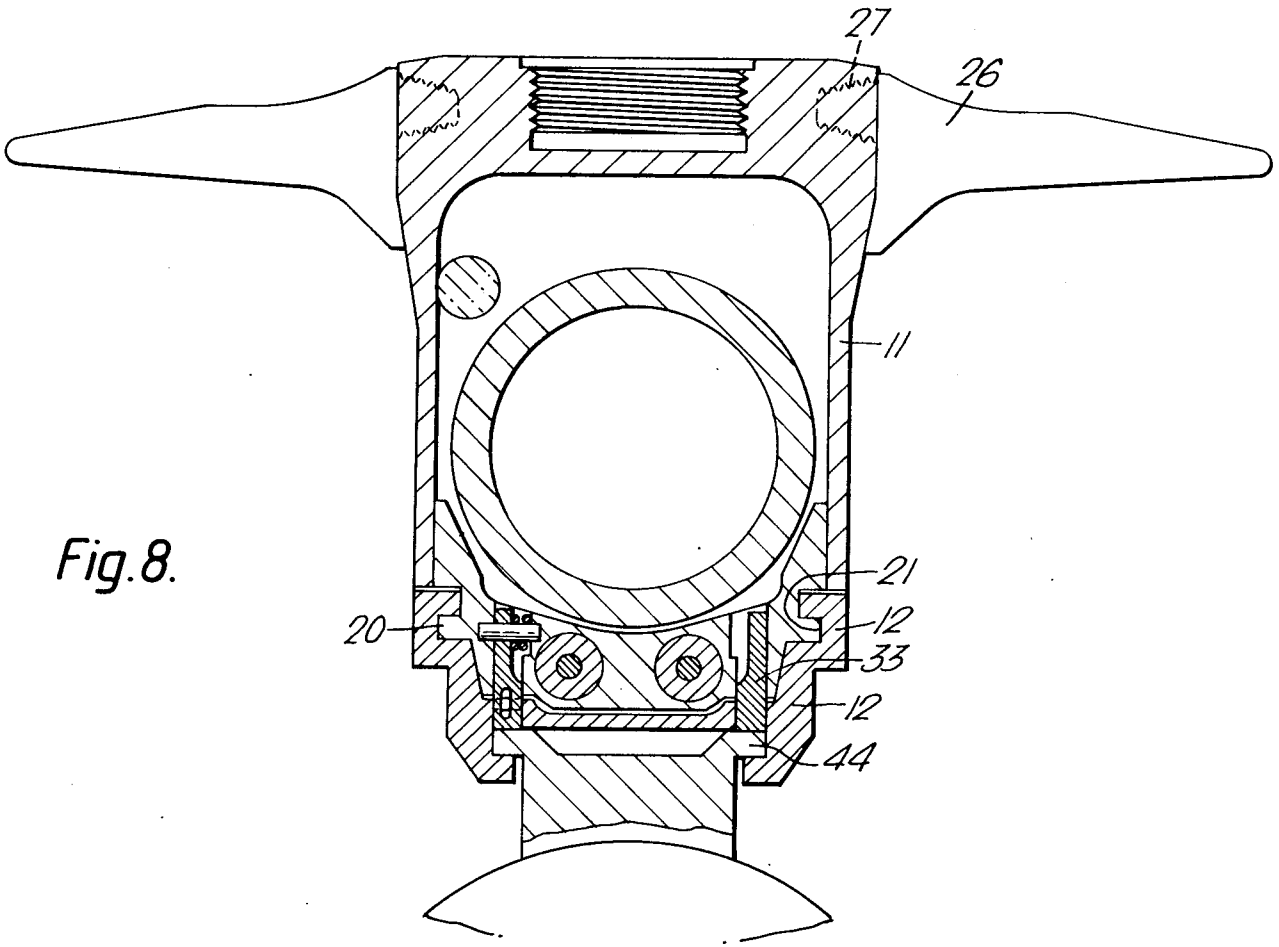

To hold the missile secure in flight, missile snubbers, to perform the same function as sway-braces, are located at the front and rear hangers and are released by the detent mechanism upon forward motion of the sub-rail. FIGS. 7 and 8 show the pairs of snubbers 32,33 to bear on AMRAAM and sidewinder missile hooks 43, 44 engaged in the outer and inner tracks 22, 23 of the sub-rail, respectively.

The facility for changing the forward and aft fairing modules allows the launcher length to be changed to the specific requirements of the missile, and avoids the unnecessary carriage of redundant components. The front and rear fairings for different missile types may be required to house variously the umbilical retract mechanism, missile wing retainers and a power supply. Each fairing is pivoted about a bottom pivot on the end of the main body, and removal of securing screws allows the fairing to swing down giving access to the body of the launcher.

In the case of a sidewinder type missile, the aft module 14 is short and purely a plastics fairing, while the forward fairing module 13 is rather long and contains a power pack 45, an umbilical 46 with a nitrogen supply for the missile fuze, and the umbilical retract mechanism. The umbilical plug 46 is connected to the missile by shear bolts 47 which shear as soon as lost motion provided by slots 48 is taken up, and the plug is then retracted by a spring-loaded lever 49. Access to attach the umbilical retract mechanism and the umbilical to the launcher is via an access cover on the nose of the fairing which is secured by a quick release screw.

The forward module 13 also has stabilising struts 50 (FIGS. 3A and 4), projecting laterally and downwardly to engage and hold the stub wings 51 of the sidewinder against aerodynamic loads in flight. These struts may each have more than one wing engagement slot to accommodate different missile wing configurations.

The fairing module 13 is subject to load via the stub wing retainers and the umbilical bolt shearing mechanism, and the structure may be fabricated in aluminium alloy with a reinforced plastics nose cover. There is a considerable weight saving in replacing metal by synthetic plastics material when the loadings will allow.

When the missile to be carried is not a sidewinder, the whole module 13 is removed and can be replaced by the short plastics fairing 15 on the same attachment points to enclose the end of the main body; this fairing has blind sockets to blank off the unused nitrogen and power supply cable connectors 52, 53.

The aft plastics fairing 14, in the sidewinder configuration, is used to enclose the rear end of the main body and give ready access for the removal or inspection of the nitrogen bottle 34. For convenience, a spring ball detent 54 is provided to prevent the front fairing from dropping when the securing screws are removed.

For the AMRAAM configuration, the aft plastics fairing 14 is removed and replaced by the fairing module 16 which houses the umbilical plug 55 and its retraction mechanism. Retraction in this case is effected by a spring-loaded lever 56 upon release of a pawl 57 by a bell crank 58 operated by a solenoid 59.

Upon launch, the sub-rail 12 is held by the detent 28 until the forward thrust due to the missile motor reaches a predetermined threshold. The thrust is then enough to overcome the spring-loading exerted by a spring pack 60 on a toggle mechanism 61 and the toggle goes over-centre allowing the lever 62 bearing the detent to rise far enough to free the sub-rail to slide forward. The spring 60 is first compressed as the thrust builds up and then, upon the toggle going over-centre, it extends and assists the operation. Cranks 84, 85 and a coupling link 86 operate a lever 82 to raise pins 83 beneath which it is engaged and pull up the striker points (sidewinder) 31 so that they are clear of the missile as it departs. A forked lever 67 retracts the umbilical plug 29 (AMRAAM) under the loading of a spring 68 when a solenoid 69 is actuated to rotate a double-armed lever 70 and release a pawl 71. The snubbers are withdrawn from the missile by cables 72 actuated by a double-armed lever 73 that is rotated by the lever 62. Although in the embodiment shown cables are used for this function, solid links may be preferred.

A pilot override, to prevent the missile being launched even although its motor has been ignited, is provided by a lock lever 74 actuated by a solenoid 75 and engaging a tail 80 on the lever 62 (FIGS. 3B and 9).

The locks constraining the missile and sub-rail to travel together during the first phase of launch are rolling locks 40 engaging the missile centre hooks, which locks are allowed to pivot aside to release the missile for sliding relatively to the sub-rail as the sub-rail approaches the end of its travel. The sub-rail is then arrested by the buffers, and as the missile departs return travel of the sub-rail is initiated by recoil of the buffers and continues due to aerodynamic loading. When the sub-rail is fully retracted, a spring-loaded plunger detent 30 latches in a recess in the sub-rail restraint block 39 and retains the sub-rail in the retracted position.

External drive points, in the form of square-ended shafts, are provided at various locations to enable the mechanisms to be operated manually on the ground. Thus, FIG. 3B shows points 78 and 79 on the main body of the launcher for operating the sub-rail release mechanism and withdrawing the umbilical plug 29, respectively. The striker points 31 can be raised manually independently of the umbilical plug 29 by turning a third square shaft 87 which causes a toggle comprising a bell-crank 89 and a spring strut 88 to go over-centre so that a forked arm 65 raises the pins 83.

By providing both 14 inch and 30 inch centre mounting points on the main body 11 of the launcher, the need for fitting an adapter in cases where the centre distances do not match is avoided. Such adapters used hitherto have added a 25lb weight penalty, and have also incurred a drag penalty by shifting the missile farther out from the aircraft.

We claim:

1. An airborne missile launcher of modular construction comprising:

(i) a main module, comprising an intermediate main body section having first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length;

(ii) a forward module, comprising a nose section and a second member of the first attachment element which cooperates with the first member to connect the nose section to the main body section in a manner where the nose section is releasably affixed to the first end of the main body section;

(iii) an aft module, comprising a tail section and a second member of the second attachment element which cooperates with the first member to connect the tail section to the main body section in a manner where the tail section is releasably affixed to the second end of the main body section; and (iv) a sub-rail adapted to carry a missile and a second member of the third attachment element which cooperates with the first member to connect the sub-rail to the main body section in a manner where the sub-rail is releasably attached to said main body section thereby upon release of the first attachment element, the nose section is removable from the main module, upon release of the second attachment element the tail section is removable from the main module and upon release of the third attachment element the sub-rail is removable from the main module where the appropriate sub-rail and nose and tail sections corresponding to a selected missile may be assembled to the main module by attaching the second members to the first members of the first, second and third attachment elements, respectively, whereby a selected missile corresponding to said nose and tail sections and said rail is releasably mountable on the launcher.

2. A missile launcher according to claim 1, wherein the sub-rail has longitudinal guides whereon it slides telescopically along the main body section.

3. A missile launcher according to claim 1, wherein the sub-rail has a plurality of longitudinal tracks to be engaged by suspension hooks of missiles of different types said tracks enabling a missile to travel along the sub-rail.

4. A missile launcher according to claim 1, wherein the main body section houses, in a removable carriage unit, a sub-rail latch mechanism, retraction means for a missile umbilical connection, and retraction means for missile striker points.

5. A missile launcher according to claim 5, wherein the main body section further houses retractable missile snubbers, and a nitrogen bottle with a nitrogen supply regulator.

6. A missile launcher according to claim 2, wherein the main body section has at its top alternative attachment points at different centre distances whereby it is carried by an aircraft, and further has at its underside forward and aft sub-rail hangers, the forward sub-rail hanger being positioned to align vertically with the forward hooks of every type of missile to be carried, and the aft sub-rail hanger being longer to give sub-rail support over a range of missile centre hook positions.

7. A missile launcher according to claim 6, wherein the rear sub-rail hanger incorporates progessive buffer means to decelerate and arrest the sub-rail at the end of its travel.

8. A missile launcher according to claim 1, further including sway brace means for removable attachment to the main body section.

9. A missile launcher according to claim 1, wherein the sub-rail is provided with releasable roller locks positioned to engage the centre hooks of each type of missile to be carried by the sub-rail.

10. A missile launcher according to claim 1, comprising alternative forward modules for different missiles, one of which is a plastics fairing while the other is longer and houses a power pack, nitrogen supply connection means, and a missile umbilical retraction mechanism.

11. A missile launcher according to claim 1, comprising alternative aft modules, one of which is a plastics fairing while the other houses a missile umbilical retraction mechanism.

12. A missile launcher according to claim 1, wherein the forward module is fixed to the forward end of the main body section by means including a bottom hinge connection and releasable securing means at the top.

13. A missile launcher according to claim 1 wherein the sub-rail translates relative to the main body section.

14. A missile launcher according to claim 13 further comprising means for resisting translation of the sub-rail relative to said main body section.

15. A missile launcher according to claim 14 where said resisting means is a detent.

* * * * *